United States Patent [19]

Hanlet

[11] Patent Number: 4,503,361

[45] Date of Patent: Mar. 5, 1985

[54] ELECTRONIC BALLAST SYSTEM

[75] Inventor: Jacques M. Hanlet, Loxahatchee, Fla.

[73] Assignee: Intent Patent A.G., London, England

[21] Appl. No.: 397,524

[22] Filed: Jul. 16, 1982

Related U.S. Application Data

[63] Continuation-in-part of Ser. No. 344,155, Feb. 2, 1982.

[51] Int. Cl.[3] ..... H05B 37/02

[52] U.S. Cl. ..... 315/221; 315/219; 315/226; 315/254

[58] Field of Search ..... 315/220, 222, 223, 201, 315/221

[56] References Cited

U.S. PATENT DOCUMENTS

| | | | |
|---|---|---|---|
| 3,396,307 | 8/1968 | Campbell | 315/221 |
| 3,418,527 | 12/1968 | Miller | 315/278 |
| 3,753,071 | 8/1973 | Engel et al. | 315/201 |
| 4,109,307 | 8/1978 | Knoll | 315/220 |
| 4,259,614 | 3/1980 | Kohler | 315/219 |
| 4,392,085 | 7/1983 | Knoll et al. | 315/223 |

*Primary Examiner*—Harold Dixon

*Attorney, Agent, or Firm*—Morton J. Rosenberg

[57] ABSTRACT

An electronic ballast system (200) which is coupled to a power source (204) in order to actuate at least one of a pair of gas discharge tubes (202 and 202'). Each of the gas discharge tubes (202, 202') include respective first and second filaments (206, 208 and 206', 208'). The system (200) includes a first transformer (238) which is coupled to the power source (204) and the first transformer (238) includes a primary winding (240) and a secondary winding (242) for establishing an oscillation signal. A first and second transistor network (252 and 254) are feedback coupled to the first transformer (238) for switching a current signal responsive to the oscillation signal. Additionally, a first and second inverter transformers (210 and 212) are provided with each of the inverter transformers (210 and 212) having in tapped windings (288 and 290) respectively, for establishing an induced voltage signal responsive to the current signal. Each of transformers (210 and 212) further include a pair of secondary windings (292, 294) as well as (296, 298). First and second coupling capacitors (308 and 310) are connected to the tapped windings (288 and 290) of the inverter transformers (210 and 212) and filaments (206 and 206') of gas discharge tubes (202 and 202') for discharging the induced voltage signal to the first filaments (206 and 206'). A first and second capacitance tuning network including the elements (312, 314 and 316, 318) are coupled to the tapped windings (288, 290) and the secondary windings (292, 294 and 296, 298) of the inverter transformers (210 and 212) for modifying a resonant frequency and a duty factor of a signal pulse generated in the inverter transformers (210 and 212).

29 Claims, 7 Drawing Figures

350
352
350
352
350
440V
0V 354
356
354
356
354
440V
0V 358
360
358
360
358
.8V
0V
-.8V 362
364
362
364
362
640V
0V 366
370
368
366
370
368
366
200V
0V
-90V 372
374
372
374
372
625V
0V
$t_0$
$t_1$
$t_2$
$t_3$
$t_4$
$t_5$

ELECTRONIC BALLAST SYSTEM

REFERENCES TO RELATED APPLICATIONS

This patent application is a continuation-in-part of U.S. patent application Ser. No. 344,155 filed on Feb. 2, 1982 and entitled "ELECTRONIC BALLAST SYSTEM".

BACKGROUND OF THE INVENTION

1. Field of the Invention

This invention pertains to electronic ballast systems for gas discharge tubes. In particular, this invention relates to an electronic ballast system for fluorescent light sources which provides a high efficiency in transforming electrical energy into the visible bandwidth of the electromagnetic spectrum. More in particular, this invention directs itself to a transistorized electronic ballast system for fluorescent light sources. More particularly, this invention pertains to an improved transistorized electronic ballast system for dual mode operation of fluorescent light sources. Additionally, the subject invention relates to a transistorized electronic ballast system which provides for a minimal number of electrical components to provide low heat dissipation within a confined volume. Still further, this invention relates to an improved transistorized electronic ballast system which allows for low cost operation and minimizes the manufacturing expenses and labor costs associated with the application thereof. Still further, this invention provides for an electronic ballast system using a DC-AC inverter system which prevents surges applied to the operating transistors through the use of a plurality of inverter transformers which are discrete in nature and thus, there is a minimization of magnetic coupling. Further, this invention directs itself to an electronic circuit wherein if one of the fluorescent light sources is removed from the circuit, there is no additional dissipation of energy.

2. Prior Art

Ballast systems for gas discharge tubes and fluorescent lightbulbs in particular are known in the art. Additionally, ballast systems for a plurality of fluorescent lightbulbs are also known in the art. However, in many prior art ballast systems, the number of electrical components contained within the circuit has been found to be relatively large. Such large number of components has led to such prior art ballast systems having relatively large volumes. The large volumes has been due in part to a number of electronic components in combination with the components used for dissipation of heat due to the disadvantageous thermal effects resulting from high heat dissipation factors when large numbers of components are being used.

SUMMARY OF THE INVENTION

An electronic ballast system coupled to a power source for at least one of a pair of gas discharge tubes. Each of the gas discharge tubes includes a first and second filament. A first transformer is coupled to the power source and has a primary and a secondary winding for establishing the frequency an oscillation signal. First and second transistor networks are feedback coupled to the first transformer for switching a current signal responsive to the oscillation signal. Additionally, first and second inverter circuit transformers are provided with each of the first and second inverter circuit transformers having a tapped winding for establishing an induced voltage signal responsive to the current signal. Each of the inverter transformers includes a pair of secondary windings. A first and second coupling capacitor are connected to the tapped windings of the inverter transformer and the first filaments of the gas discharge tubes for discharging the induced voltage signal to the first filament. First and second capacitance tuning networks are coupled to the tapped windings and secondary windings of the inverter circuit transformer for modifying a resonant frequency and a duty factor of a signal pulse generated in the inverter circuit transformer when a gas discharge tube has been removed from the system. However, when this gas discharge tube is removed, the pulse repetition rate remains unchanged. Additionally, the duty factor in the portion of the circuit containing the remaining gas discharge tube remains unaffected.

The combination of the first and second capacitance tuning networks fulfills distinct functions. The first and second capacitance tuning networks prevent generation of large voltage spikes due to leakage inductance of the second inverter transformer where the voltage spikes are produced by the leading edge of the driving pulse supplied by the first inverter circuit transformer. In some prior art circuits the voltage spikes have been damped by snubber circuits which have consumed appreciable amounts of power which have been dissipated as heat.

Additionally, the combination of first and second capacitance tuning networks prevent generation of large voltage pulses during transistor "off" time whenever the gas discharge tube is removed from the circuit. The second capacitance tuning network coupled in parallel relation with the gas discharge tube does not affect performance characteristics of the system since the reactive terms are large compared to the resistance of the shunted gas discharge tube.

DESCRIPTION OF THE PREFERRED EMBODIMENTS

Figure 1:
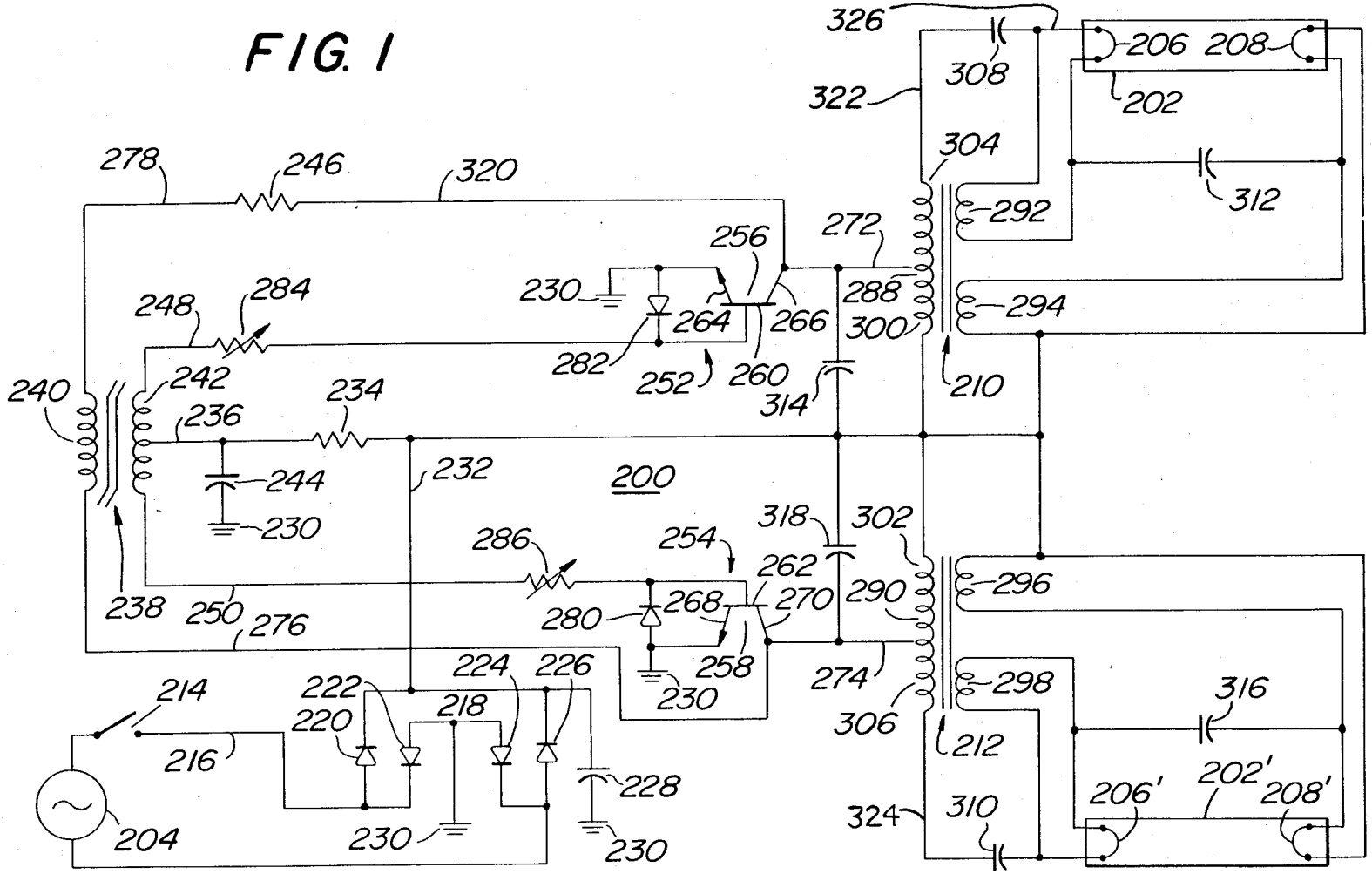
FIG. 1 is an electrical schematic diagram of the electronic ballast system network.

Referring now to FIGS. 1 and 2, there is shown electronic ballast system 200 coupled to power source 204 to actuate at least one of a pair of gas discharge tubes 202 and 202'. Gas discharge tubes 202 and 202' include first and second filaments 206, 208, and 206', 208', respectively. Gas discharge tubes 202 and 202' may be fluorescent type lamps to be more fully described in following paragraphs. In overall concept, electronic ballast system 200 is directed to maximizing the efficiency of light output from gas discharge tubes 202 and 202' with respect to power input from power source 204. Additionally, electronic ballast system 200 is further directed to the minimization of electrical components for activation of gas discharge tubes 202 and 202', resulting in a lower labor cost and low overall manufacturing cost, than those system provided in the prior art. Operating costs are greatly effected and lowered over prior art systems, due to the higher efficiencies attained by electronic ballast system 200 when taken with respect to other ballast systems known. Still further, with the minimization of electrical components in combination with the simplicity of the circuitry associated with electronic ballast system 200, the reliability of system 200 is further increased and the operating lifetime is maximized.

Referring now to FIG. 1, there is shown power source 204 to provide power for electronic ballast system 200. Power source 204 may be an AC source of 120 V., 240 V., 277 V., or any acceptable standardized AC power supply voltage. In general, power source 204 may be a DC power source which may be applied directly within system 200 in a manner well-known in the art by merely removing various bridging and filtering elements as will be further described in following paragraphs. In fact, where power source 204 is changed from a 120 V. AC signal, the only changes to be made to electronic ballast system circuitry 200 will be a corresponding interchange of first and second inverter transformers 210 and 212 having values which would accomodate a predetermined AC power source.

Power to electronic ballast system 200 is applied from power source 204 through switch 214 which may be a single pole, single throw switch mechanism. Power inputs through power line 216 to full wave bridge circuit 218 which is standard in the art. Full wave bridge circuit 218, as is clearly shown, is formed of diodes 220, 222, 224 and 226 for providing rectification of AC voltage from power source 204 inserted through power line 216. Diodes 220,222, 224 and 226 mounted in the standard full wave bridge circuit configuration 218 provide a pulsating DC voltage signal which is filtered by filter capacitor 228. Filter capacitor 228 averages out the pulsating DC voltage signal to provide a smooth signal for system 200. Diodes 220, 222, 224 and 226 making up full wave bridge circuit 218 are commercially available diodes having a designation 1N4005. As is clearly seen, one end of bridge circuit 218 is coupled to ground 230 to be the return path for the DC supply with the opposing end of bridge circuit 218 providing DC power input to system 200 through line or power input line 232. Filter capacitor 228 is coupled to line 232 for providing the filtering of the DC signal driving system 200. Filter capacitor 228 is a commercially available 200 microfarad, 450 volt capacitor.

The voltage signal passing through power input line 232 is inserted to second transformer resistor 234 and is coupled to center tap line 236 of first transformer 238 having first transformer primary winding 240 and first transformer secondary winding 242 which is center tapped by center tap line 236. Thus, it is clearly seen that first transformer 238 is coupled to power source 204 and includes primary winding 240 and secondary winding 242 for establishing the frequency of an oscillation signal for electronic ballast system 200. First transformer secondary winding 242 is center tapped by center tap line 236 for establishing a feedback signal of opposing polarity with respect to the center tap. Second transformer resistor 234 is merely a current limiting resistor element and in one illustrative embodiment, has a value of approximately 200,000 ohms. First transformer capacitor 244 is coupled on opposing ends to ground 230 and to center tap line 236. First transformer capacitor 244 provides an AC reference to ground at that point and is simply an AC coupling capacitor.

Thus, the circuitry for first transformer 238 includes second transformer resistor 234 having a predetermined value as has been previously described, which is coupled in series relation to the center tap of first transformer 238 through center tap line 236 coupled to first transformer secondary winding 242 and initiates the oscillation process. Essentially, this provides for the initiation of the operation of electronic ballast system 200 when switch 214 is closed. Additionally, first transformer capacitor 244 is coupled to center tap line 236 and to second transformer resistor 234 to provide the reference value for the oscillating signal with respect to ground 230.

It is to be understood that first transformer capacitor 244 provides an AC reference to ground 230 and in combination with second transformer resistor 234 provides a time delay of the order of magnitude of several seconds in the ignition of gas discharge tubes 202 or 202'. During this time delay, first transformer capacitor 244 charges exponentially, allowing the voltage pulse amplitude generated in transformer 238, 210 or 212 to increase in a substantially exponential manner which progressively heats filaments 206, 208, or 206', 208' prior to gas discharge tubes 202 or 202' reaching their voltage breakdown value, thus having the effect of improving the operational life of tubes 202 and 202'. Subsequent to a first pulse, an oscillatory signal is established and first transformer capacitor 244 acts only as a reference to ground 230 for the AC signal and the DC potential appearing across capacitor 244 is of negligible voltage.

First transformer 238 further includes a first transformer resistor 246 having a predetermined resistance value coupled in series relation to primary winding 240 of first transformer 238 for establishing a predetermined frequency value for the oscillation signal. The first transformer resistor 246 will be detailed in further paragraphs during further description of overall circuit for system 200. For purposes of illustration only, first transformer primary winding 240 is a winding of 172 turns and first transformer 238 may be a ferrite core transformer which is operated in a saturation mode during operation of system 200 and gas discharge tubes 202 and 202'.

Electronic ballast system 200 further includes first and second transistor circuits 252 and 254, respectively, being feedback coupled to first transformer 238 to allow switching a current signal responsive to the feedback signal produced. Referring now to first transformer second winding 242 which is center tapped, current thus is divided and flows through both first transistor line 248 and second transistor line 250. First and second transistor circuits 252 and 254 include first transistor and second transistor 256 and 258, respectively. First transistor 256 includes first transistor base 260, first transistor emitter 264, and first transistor collector 266. Second transistor 258 includes second transistor emitter 268 and second transistor collector 270. Both of first and second transistors 256 and 258 are for description purposes of the NPN type and commercially available.

Current from lines 248 and 250 flow respectively to base elements 260 and 262 of first and second transistors 256 and 258. One of first or second transistors 256 and 258 will have a slightly higher gain than the other and will be turned to the conducting state. When either first transistor 256 or second transistor 258 becomes conducting, such holds the other first or second transistor 256 or 258 in a non-conducting state for the predetermined time interval during which one of the transistors is in the conducting or "on" state. Assuming for the purposes of illustration that second transistor 258 goes into the conducting state, the voltage level of second transistor collector 270 is brought into the neighborhood of second transistor emitter 268 within approximately 1.0 volts. As is seen in the circuit figures, since emitter 268 is tied to ground 230, collector 270 is in turn coupled to ground 230. In a similar manner, it is seen that the first transistor emitter 264 is coupled to ground 230 and during the conducting state, first transistor collector 266 is also coupled to ground 230. As can be seen, current from line 232 is coupled into first inverter circuit transformer and second inverter circuit transformer 210 and 212. Additionally, collectors 266 and 270 of first and second transistors 256 and 258 are tapped through off-center tap lines 272 and 274 into first inverter circuit transformer 210 and second inverter circuit transformer 212. Emitter elements 264 and 268 are thus essentially coupled to ground 230 and base elements 260 and 262 are coupled to secondary winding 242 of first transformer 238.

When transistor 258 goes to the conducting state, second transistor collector 270 is substantially at ground potential and thus, current flows through primary winding 240 of first transformer 238, from second transistor collector 270. Current from collector 266 is input to first transformer primary winding 240 through collector line 320 and passes through first transformer resistor 246 to line 278. First transformer resistor 246 in combination with primary winding 240 defines and controls the frequency at which oscillations will occur. The control of the frequency passing through line 278, first winding 240, collector line 276 into collector 270 and emitter 268 of second transistor 258, and finally to ground 230. Transistor diodes 280 and 282 are of the class designation 1N156 and are commercially available, providing a path to ground 230 for any negative pulses that occur on base elements 262 and 260. This provides a voltage protection for the base-emitter junction for transistors 258 and 256.

When current flows through primary winding 240 of first transformer 238 into line 276, from collector 266 of transistor 256, to collector 270 of transistor 258, transformer 238 is wound in a manner such that the polarity of secondary winding 242 will place a positive signal to base 262 of second transistor 258. Each of transistor circuits 252 and 254 include respective transistor base variable resistors 284 and 286 which are coupled on opposing ends to respective base elements 260 and 262, as well as to secondary winding 242 of first transformer 238. First and second transistor base variable resistors 284 and 286 control the amplitude value of the feedback signal passing therethrough. As has been stated previously, transistor diodes 282 and 280 are coupled in parallel relation to respective base elements 260 and 262, as well as to emitter elements 264 and 268. As is seen in the Figure, transistor diodes 282 and 280 have a polarity opposite to the polarity of the junction of base and emitter elements 260, 264 and 262, 268.

Further, each of collector elements 266 and 270 of first and second transistors 256 and 258, respectively, have been shown to be coupled to primary winding 240 of first transformer 238 and are coupled to tapped primary windings of inverter circuit transformers 210 and 212, respectively. Transistors 256 and 258 are driven between a conducting state and a non-conducting state responsive to the feedback signal produced with first and second transistors 256 and 258 being alternatively driven between the conducting and the non-conducting states.

System 200 further includes first and second inverter circuit transformers 210 and 212 with each of first and second inverter circuit transformers 210 and 212 having respective tapped windings 288 and 290 for establishing an induced voltage signal responsive to a change in the incoming current signal. Further, each of first and second inverter circuit transformers 210 and 212 include respective secondary windings 292, 294 and 296, 298. It is to be clearly understood that first and second inverter circuit transformers 210 and 212 are discrete and separate each from the other. This distinction and discreteness not found in the prior art is of extreme importance, due to the fact that when inverter circuit transformers 210 and 212 are made discrete, such eliminates magnetic coupling between the windings of transformers 210 and 212 and thus minimizes the possibility of transistor turn "on" at the same time and resulting in conducting overlap, and this important consideration minimizes transients which would be established in the windings of inverter circuit transformers 210 and 212. It is to be further noted that tapped windings 288 and 290 of first and second inverter transformers 210 and 212 are tapped in a manner to provide an auto-transformer type configuration. It is to be noted that tapped lines 272 and 274 are off-center tapped lines for windings 288 and 290.

Thus, tapped windings 288 and 290 are tapped by lines 272 and 274 in a manner to provide primary winding sections 300 and 302, as well as secondary windings 304 and 306 for respective tapped windings 288 and 290. Thus, in reality, inverter circuit transformers 210 and 212 both include three secondary windings 292, 294, 304, and 296, 298 and 306, respectively, and associated primary winding sections 300 and 302. Each of tapped windings 288 and 290 are thus tapped in a manner to provide respective primary windings 300 and 302 coupled in series relation to third secondary windings 304 and 306. In this type of configuration, voltage in primary sections 300 and 302 are added respectively to secondary voltages and current in third secondary windings 304 and 306. Looking at inverter circuit transformer 212, current flows through the primary section 302 to the collector 270 of transistor 258 which is in a conducting state. When a switching takes place, transistor 258 goes to an non-conducting mode which causes a rapid change in current and produces a high voltage in primary section 302 approximating 400.0 volts and in secondary portion 306 approximating 200.0 volts which are added together and this voltage is seen at second coupling capacitor 310.

First and second coupling capacitors 308 and 310 are connected to tapped windings 288 and 290 of first and second inverter circuit transformers 210 and 212, as well as to first filaments 206 and 206', respectively, of gas discharge tubes 202, 202' for discharging the induced voltage signal to first filaments 206 and 206'.

Thus, third secondary windings 304 and 306 are coupled in series relation to each of first and second coupling capacitors 308 and 310 for developing the sum of the induced voltages in primary sections 300 and 302 and third secondary windings 304 and 306, respectively within first and second coupling capacitors 308 and 310.

In one particular electronic ballast system 200 now in operation, first transformer 238 includes 172 turns of number 28 wire for transformer primary winding 240 and 2.5 turns of number 26 wire on both sides of center tap line 236. First transformer 238 is commercially available and has a designation Ferrox-cube 2213LO3C8. Additionally, each of first and second inverter circuit transformers 210 and 212 includes tapped windings 288 and 290 of 182 turns of number 26 wire. Tapped windings 288 and 290 include respective tapped portions 300 and 302 of 122 turns each and portions 304 and 306 of 60 turns each. Each of windings 292, 294, 296 and 298 are formed of 2 turns of number 26 wire. Inverter circuit transformers 210 and 212 are commercially available and have a commercial designation Ferroxcube 2616PA1703C8.

System 200 further includes first and second capacitance tuning circuits, having respectively first tuning capacitor 312, second tuning capacitor 314, and first tuning capacitor 316, and second tuning capacitor 318, coupled in a manner to be described in following sentences. Capacitors 312 and 314 forming the first capacitance tuning circuit components are coupled to windings 292,294 and tapped windings 288 of first inverter circuit transformer 210. First tuning capacitor 316 of second capacitance tuning circuit is coupled between secondary winding 298 and 296 of inverter circuit transformer 212 and second tuning capacitor 318 is coupled to tapped winding 290. Such coupling allows for the modification of a resonant frequency and a duty factor of a signal pulse generated in inverter circuit transformers 210 and 212. This prevents generation of any destructive voltage signals to first and second transistors 256 and 258 respectively, responsive to removal of at least one of gas discharge tubes 202 or 202' from the system.

Secondary windings 292 and 294 of first inverter circuit transformer 210 respectively heat filaments 206 and 208 of gas discharge tube 202. Similarly, secondary windings 296 and 298 of second inverter circuit transformer 212 are used for heating filaments 208' and 206', respectively.

Returning to first and second capacitance tuning circuitry, it is seen that first tuning capacitor 312 is coupled in parallel relation with first and second filaments 206 and 208 of gas discharge tube 202. Second tuning capacitor 314 is coupled also in parallel relation to tapped winding 288 of inverter circuit transformer 210. Similarly, first tuning capacitor 316 is coupled in parallel relation across filaments 206' and 208' of gas discharge tube 202'. Second tuning capacitor 318 is in parallel relation with tapped primary winding 290 of second inverter circuit transformer 212.

First tuning capacitors 312 and 316 have predetermined capacitive values for increasing the conducting time interval of at least one of first or second transistors 256 and 258 with respect to a non-conducting time interval of such transistors 256 or 258 when one of gas discharge tubes 202 or 202' is electrically disconnected from the system.

Assuming transistor 258 goes to the non-conducting state, a high voltage input is presented to second coupling capacitor 310, such capacitor 310 thus charges to substantially the same voltage level which is a voltage level approximating 600.0 volts. However, prior to when transistor 258 goes to the conducting mode, the induced voltage decreases and when the voltage drops below the voltage that capacitor 310 has charged up to, such capacitor 310 thus becomes a negative voltage source for the system. When transistor 258 goes from a non-conducting state to a conducting state, a surge of current passes through primary winding 240 of first transformer 238 which produces a secondary voltage in secondary winding 242. Transformer 238 is designed for a short saturation period and thus, the voltage on secondary winding 242 is limited and current flows through line 250 and through variable resistor 286 to base 262 of transistor 258 in order to maintain it in a conducting state. However, once this surge of current becomes a steady state value, first transformer 238 no longer produces a secondary voltage and base current drops to substantially a zero value and transistor 258 goes to a non-conducting mode. This change in the current in primary winding 240 produces a secondary voltage which turns first transistor 256 into a conducting mode. Similarly, transistor 256 produces a surge of current on line 320 producing once again a secondary voltage to maintain it in a conducting mode until a steady state value is achieved and then transistor 256 goes to a non-conducting mode and such becomes a repetitive cycle between transistors 256 and 258. The frequency at which the cycling occurs is dependent upon the primary winding inductance 240 of transformer 238 in combination with first transformer resistor 246.

Thus, the cycling frequency is a function of the number of turns of first transformer primary winding 240 and the cross-sectional area of the core of first transformer 238. The half period is a function of this inductance and the voltage across primary winding 240. The voltage across the primary winding 240 is equal to the collector voltage of the transistor in the "off" state minus the voltage drop across first transformer resistor 246 and the voltage drop across the collector-emitter junction of the transistor in the "on" state. Thus, since the two collector-emitter junction voltage drops of the transistors when they are in the "on" state are not identical, the two half periods making the cycling frequency are not equal.

Safety features have been included within electronic ballast system 200 which have already been alluded to and partially described. In particular, if one of gas discharge tubes 202 and/or 202' are removed from electrical connection, auto-transformers 210 and 212 may produce an extremely high voltage which would damage and/or destroy transistors 256 and/or 258. In order to maintain a load even with the removal of tubes 202 and 202', first tuning capacitor 312 which is a 0.005 microfarad capacitor is coupled across tube 202 in parallel relation with respect to filaments 206 and 208, as well as secondary windings 292 and 294. First tuning capacitor 312 thus provides a sufficient time change to the time constant of the overall LC network such that the duty cycle increases in length. This has the effect of changing the operating frequency or resonant frequency of the LC combination and thus produces a significantly lower voltage applied to transistor 256. Obviously, a similar concept is associated with first tuning capacitor 316 of second tuning circuit in relation to second transistor 258. Second tuning capacitor 314 is a 0.006 microfarad capacitor and is coupled in parallel relation to primary winding portion 300 of inverter transformer 210 winding 288. A similar concept applies to second tuning capacitor 318 for the second tuning circuit. This also becomes a portion of the frequency determining network for the overall system 200 when one of the gas discharge tubes 202 or 202' is removed from the system.

The values of inductance of primary windings 300 and 302 and the capacitive values of second tuning capacitors 314 and 318 are selected such that their resonant frequency is substantially equal to the cycling frequency. First tuning capacitors 312 and 316 do not effect the resonant frequency, since their capacitive reactance is large when taken with respect to the reactance of ignited gas discharge tubes 202 and 202'. The low resistance of gas discharge tubes 202 and 202' are reflected in primary windings 300 and 302 which lowers the resonant frequency and the Q of the circuit thus lowering the induced voltage in primary windings 300 and 302. Since this voltage is seen across the transistor in the "off" state, it contributes to the determination of the half period of the cycling frequency.

When a gas discharge tube 202, or 202' is removed, the series resonance of the combined elements 304, 312 or 306, 316 is in parallel relation with corresponding tuned circuit elements 300, 314 or 302, 318 which increases the resonant frequency of the combined circuit elements which is opposite to what happens when the gas discharge tube is in the circuit.

Without first tuning capacitors 312 and 316 and the auto transformer configuration of the transformers 210 and 212 in system 200, it would be seen that where a gas discharge tube 202 or 202' is removed, the induced voltage in primary winding 300 or 302 would be determined by the inductance of the winding multiplied by the change in current with respect to time through the winding 300 or 302 and such would exceed the operational capabilities of a particular transistor 256 and 258.

In the event that power source 204 were changed to another type of standard AC power signal such as 240 volts or 277 volts, the only element to be changed in overall system 200 are first and second inverter circuit transformers 210 and 212. In this case, the windings 288 and 290 would be changed in accordance with the formula, the number of windings would be equal to the DC supply voltage minus one times ten to the eighth divided by four times the frequency times the maximum magnetic flux times the cross-section of the core. The secondary windings such as 292 and 294 would also have to be maintained in the same proportion to the windings in the primary 288. Thus, if the primary windings are doubled so the secondary windings must also be doubled. Thus, the turns ratio must remain the same to produce the same filament voltage. Thus, when a tube 202 or 202' is removed from the system, in that portion of the network, the system becomes purely reactive and there is no dissipation of energy with the exception of a small loss in the particular transistor 256 or 258 and associated resistance in respective windings.

Now referring to FIGS. 2A–2F, there is shown the timing diagrams and associated voltage waveforms for electronic ballast system 200. The abcissa of each of the graph waveforms is a time parameter with $t_1$ being the time at which transistor 256 is being turned "on". The time differential between $t_1$ and $t_2$ is approximately 24 microseconds and represents the time interval during which transistor 256 is in the "on" state, which is a function of the number of turns of primary winding 240 of first transformer 238, the voltage across primary 240 and the cross-sectional area of the core of transformer 238. Likewise, $t_3$ is the time at which transistor 258 is being turned "on". The time that transistor 258 is in the "on" state is represented by the differential between $t_3$ and $t_4$ and is similarly close to 24 microseconds for transistor 258, but is not identical to the transistor 256 "on" time due to differences in the collector to emitter saturation voltages of transistors 256 and 258 as has been previously described.

At time $t_0$, transistor 258 turns to an "off" state. The duration of transistor 258 "off" state is represented by the time differential between $t_0$ and $t_3$ which is approximately 31 microseconds. Likewise, the "off" state for transistor 256 begins at time $t_2$. Transistor 256 remains "off" until time $t_5$. Transistor 256 has an "off" state duration represented by the difference in time between $t_2$ and $t_5$, which is approximately 31 microseconds, but is not identical to the "off" state duration of transistor 258 due to the tolerance of the values of capacitors 314 and 318 and the inductance of primary windings 300 and 302.

The time interval from $t_0$ to $t_4$ is identical to the time interval from $t_1$ to $t_5$ and is approximately 55 microseconds. This time represents the period of oscillation for the system. The frequency of system 200 has been designed to provide approximately 18,200 cycles per second, being above the upper limit of the human audible range.

Figures 2A, 2B, 2C, 2D, 2E, 2F:
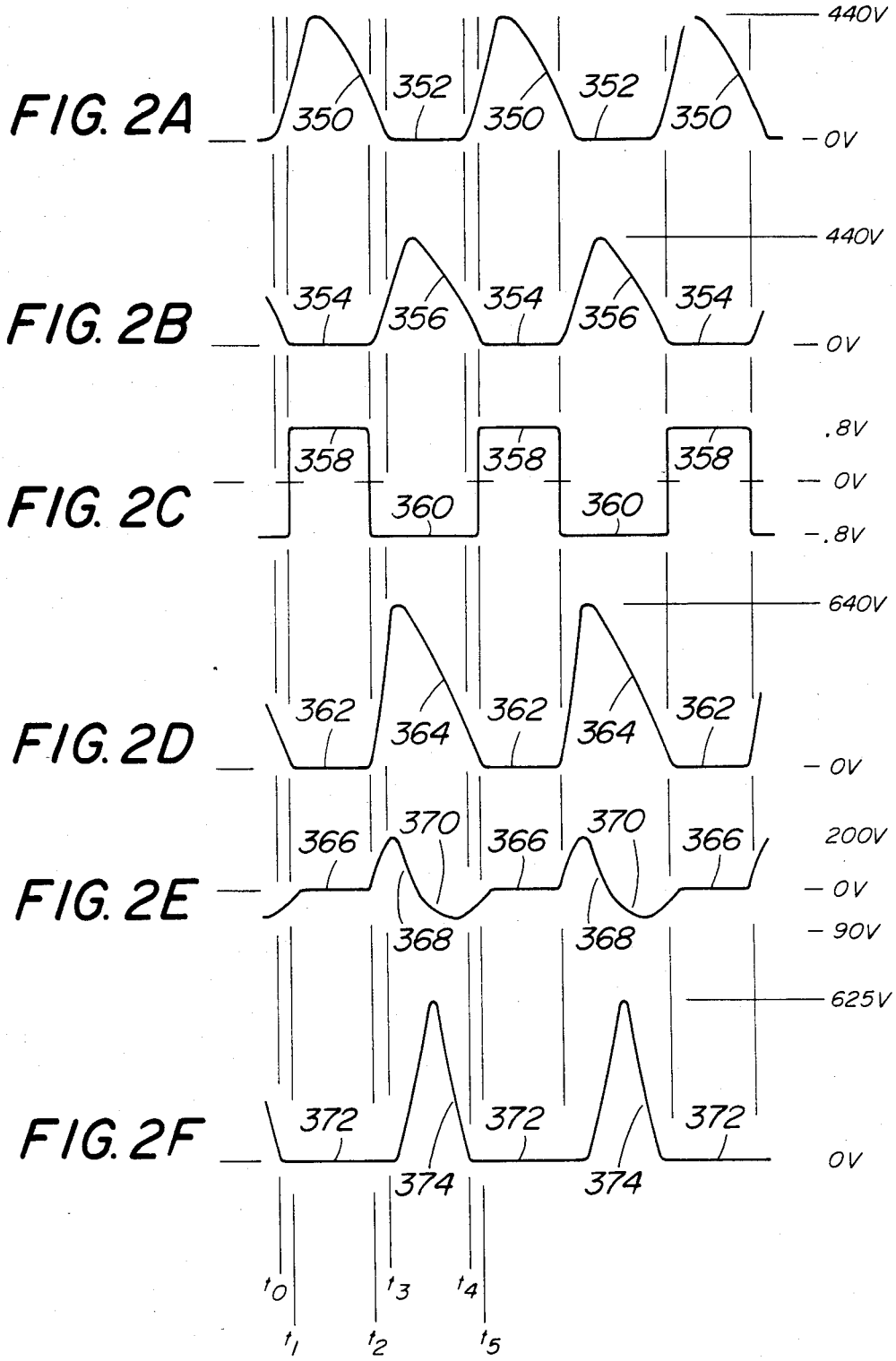
FIG. 2A is an electrical signal diagram directed to the voltage between the collector and emitter of the second transistor.
FIG. 2B is the voltage signal between the collector and emitter of the first transistor.
FIG. 2C is the voltage signal between the base and emitter of the first transistor.
FIG. 2D is a voltage signal diagram directed to the voltage signal across the series combination of the collector capacitor, the coupling capacitor, and a gas discharge tube.
FIG. 2E is the voltage signal across a gas discharge tube.
FIG. 2F is a voltage signal across the collector to emitter of a transistor, with one of the gas discharge tubes removed from the circuit.

Referring now to FIG. 2A, such represents the voltage on line 274 of FIG. 1. Initially at $t_0$, transistor 258 is placed in an "off" state and the voltage from the collector 270 to the emitter 268 rises to a value of approximately 440 V. due to the induced voltage generated in the primary winding 302 of second inverter circuit transformer 212. This energy is dissipated in the ionized gas of discharge tube 202'. At time interval $t_3$, transistor 258 is turned to an "on" state and the collector to emitter voltage is clamped to approximate zero volts. The collector current which flows through transistor 258 during the "on" state represented by the time period from $t_3$ to $t_4$ is the means by which energy is stored in the magnetic field of primary winding 302 of second inverter circuit transformer 212. It should be understood that this stored energy is used in the next half cycle to produce the induced high voltage which is approximately several times the D.C. supply voltage.

Referring now to FIG. 2B, it is seen that a similar voltage waveform as depicted in FIG. 2A is produced with the exception that the voltage waveform shown in FIG. 2B represents the voltage on line 272 of FIG. 1. It should be noted that since this electronic ballast circuit is symmetrical in design, the collector to emitter voltages should be approximately equal in magnitude and 180° out-of-phase with one another, as can be seen by comparison of FIG. 2A and FIG. 2B. It should also be noted that the time interval represented by the difference between $t_0$ and $t_1$, $t_2$ and $t_3$, and $t_4$ and $t_5$ is approximately eight to ten microseconds, and is an overlap of transistor "off" states. This transistor "off" state overlap in prior art designs could have deleterious effects on transistor life, since the induced voltages are present substantially simultaneously on both inverter circuit transformer windings. By using discrete transformers and thus avoiding magnetic coupling, the simultaneous occurence of induced voltage has no such damaging effects.

Referring now to FIG. 2C, the waveform represented is the voltage on transistor base 260 of first transistor 256. This voltage is initially at approximately a negative 0.8 volts and at $t_1$, the voltage rises to approximately a positive 0.8 volts and remains at that approximate voltage until $t_2$, when it drops back to an approximate negative 0.8 volts. This voltage waveform is clamped at those respective values by the diode 282 for the negative half-cycle and the transistor 256 base-emitter junction for the positive half-cycle. It should be recognized that by virtue of the center tapped secondary winding, the voltage waveform applied to the base 262 of second transistor 258 will be of approximately equal amplitude but 180° out-of-phase. However, the pulse duration of the voltage applied to the base 262 will not be identical to the duration of the positive and negative pulses represented in FIG. 2C. This pulse duration difference is a function of differences in the induced voltages generated in the primary windings 300 and 302 of inverter circuit transformer 210 and 212, respectively. The difference in the induced voltages are the result of the tolerances in component values of the first and second inverter circuit transformer and first and second tuning capacitors 312, 314 and 316, 318.

Referring to FIG. 2D, such represents the voltage waveform on line 322 of FIG. 1, which is the sum of voltages generated in first inverter circuit transformer primary winding 300 and secondary winding 304. This voltage waveform is identical in phase, frequency, and pulse duration to that depicted in FIG. 2B. The waveform differs only in the amplitude of the voltage pulse that is generated during the time interval defined from $t_2$ to $t_5$ since the totally induced voltage is the sum of the voltages generated in the primary and secondary windings 300 and 304. The first inverter circuit transformer secondary winding 304 contributes approximately 200 volts to the signal, thus the peak of the voltage waveform represented in FIG. 2D is approximately 640 volts. Likewise, the voltage waveform appearing on line 324 of FIG. 1 would have an approximate peak voltage of 640 volts, being the sum of induced voltages generated in second inverter circuit transformer primary winding 302 and secondary winding 306. This voltage waveform is otherwise identical to the voltage represented by FIG. 2A.

Referring now to FIG. 2E, a voltage waveform is represented which corresponds to the voltage on line 326 in FIG. 1, which is the voltage applied to the gas discharge tube 202. At time $t_2$, the voltage begins to increase across the gas discharge tube 202 coincident with the rise of induced voltage generated in first inverter circuit transformer 210. When the induced voltage drops below the value to which first coupling capacitor 308 has charged, it becomes a negative voltage source for the gas discharge tube 200. It continues to excite the gas discharge tube during transistor 256 "on" state, due to its stored energy. The gas discharge tube will go to an "off" state, the capacitor charge is depleted, and then will be reignited when the cycle is repeated.

Referring now to FIG. 2F, the voltage waveform represents the voltage which would appear on line 272 of FIG. 1, when gas discharge tube 202 is electrically removed from the circuit. Comparing this waveform with the one in FIG. 2B, which is the voltage at the same point in the circuit but with the gas discharge tube connected, it is seen that the amplitude of the waveform in FIG. 2F is about 175 volts greater than that of FIG. 2B. It is evident that the period ($t_0$ to $t_4$) of the waveform between FIGS. 2B and 2F is substantially the same, however the duty cycle of the transistor "on" time is significantly longer for the condition represented by the waveform of FIG. 2F.

Referring now to FIGS. 1 and 2, there is provided a method of producing light output from at least one gas discharge tube having a first and second filament. As shown in FIG. 2A, an induced voltage in primary winding 302 of second inverter circuit transformer 212 is generated during the $t_0$–$t_3$ time interval as shown by signal line 350. From the time interval from $t_3$ to $t_4$, signal line 352 represents the collector to emitter voltage of second transistor 258 during its "on" state which is approximately zero volts.

Similarly, FIG. 2B represents the induced voltage in primary winding 300 of first inverter circuit transformer 210. During the time interval from $t_2$ to $t_5$, the induced voltage is generated and is shown by signal line 356. Signal line 354 depicts the collector to emitter voltage of first transistor 256 during the time period, $t_1$ to $t_2$, it is in the "on" and is approximately zero volts.

As shown in FIG. 2C, the voltage applied to the base 260 of first transistor 256 is at a positive 0.8 volts, as represented by signal line 358, during transistor 256 "on" time $t_1$ to $t_2$. During first transistor 256 "off" state, the time interval $t_2$ to $t_5$ the base voltage is at the negative 0.8 volts, as shown by signal line 360, and is clamped at that level by diode 282 to prevent damage to transistor 256.

In FIG. 2D, there is shown the summation of voltages from primary winding 300 and secondary winding 304 as is present on line 322 of FIG. 1. Thus, as is shown by signal line 362, the voltage is approximately zero volts during the first transistor "on" state $t_1$ to $t_2$. The induced voltages generated by both windings, as represented by signal line 364, sums to a maximum amplitude of approximately 640 volts.

FIG. 2E represents the voltage waveform appearing on line 326 of FIG. 1, and depicts the voltage across the gas discharge tube 202. At time $t_2$, the voltage increases from zero as the induced voltage in first inverter circuit transformer 210 rises and is coupled to the gas discharge tube by first coupling capacitor 308. The voltage rises to a peak of approximately 200 V., as shown by signal line 368, and then falls back to zero volts as the induced voltage drops. Once the induced voltage has dropped sufficiently, the first coupling capacitor 308 becomes a negative voltage source for the gas discharge tube 202, as shown by signal line 370. The capacitor continues to provide energy for the gas discharge tube beyond the time $t_5$ when first transistor 256 turns to an "on" state and the induced voltage is no longer present. When the capacitor has fully discharged, as indicated by signal line 366, the voltage across the gas discharge tube 202 is equal to zero volts and remains at that level for approximately 25 microseconds, until the next cycle begins.

If gas discharge tube 202 were electrically removed from the circuit, as might occur when it reaches its end of life and fails, the voltage waveform in FIG. 2F would represent the induced voltage of first inverter transformer primary winding 300. As indicated by signal line 372, the first transistor 256 "on" state is increased in time, as can be compared with signal line 354 of FIG. 2B. This increase in duty factor is a result of first and second tuning capacitors 312 and 314. Since the overall period of the waveform must remain the same, being a function of resistor 256 and first transformer 238, the length of time the induced voltage is present is reduced from approximately 31 microseconds to 25 microseconds, and increases amplitude from approximately 440 volts to 625 volts as shown by signal line 374. In the event that tuning capacitors 312, 314 and 316, 318 were not present in the circuit to shift the resonant frequency, the induced voltage would be higher and may have deleterious effects on transistors 256 and 258.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An electronic ballast system coupled to a DC power source for a pair of gas discharge tubes, each of said gas discharge tubes having a first and second filament, comprising:

(a) first and second autotransformers, each of said first and second autotransformers having (1) a first terminal commonly connected to one terminal of said power source and the junction point of said gas discharge tubes, (2) a tap terminal, and, (3) an output terminal connected respectively to opposite ends of said gas discharge tubes;

(b) feedback transformer means having a primary and secondary winding for establishing an oscillation signal;

(c) first and second transistor means having input electrodes coupled to a reference potential and output electrodes coupled respectively to said tap terminals of said first and second autotransformers and to opposing ends of said feedback transformer primary winding, and first and second transistor control means being connected at opposing ends of said secondary winding of said feedback transformer means for switching a current signal responsive to a feedback signal alternately through one of said transistor means;

(d) first and second coupling capacitors connected on a first end in series with the output end of each of said first and second autotransformers, said coupling capacitors being coupled respectively on a second end to said first filaments of said first and second gas discharge tubes respectively for discharging a summed induced voltage signal to said first filaments; and, (e) first and second capacitance tuning means associated with each of said gas discharge tubes, said second of which is coupled to each of said tap terminals of said first and second autotransformers respectively and said power source, said first capacitance tuning means being in shunt with said gas discharge tubes for modifying a resonant frequency and a duty factor of a signal pulse generated in said first and second autotransformers.

2. The electronic ballast system as recited in claim 1 where said first and second capacitance tuning means prevents generation of destructive voltage signals to said first and second transistor means responsive to removal of at least one of said gas discharge tubes from said system.

3. The electronic ballast system as recited in claim 1 where said first and second capacitance tuning means includes:

(a) at least one first tuning capacitor coupled in parallel relation with said first and second filaments of one of said gas discharge tubes; and, (b) at least one second tuning capacitor coupled in parallel relation to said tapped primary winding of at least one of said autotransformer.

4. The electronic ballast system as recited in claim 3 where said first tuning capacitor is further coupled in parallel relation with said secondary windings of at least one of said autotransformers.

5. The electronic ballast system as recited in claim 3 where said first and second tuning capacitors include a predetermined capacitive value for increasing a conducting time interval of at least one of said first and second transistor means with respect to a non-conducting time interval of said first and second transistor means when at least one of said gas discharge tubes is electrically disconnected from said system.

6. The electronic ballast system as recited in claim 1 where said secondary winding of said feedback transformer means is center tapped for establishing said oscillation signal of opposing polarity with respect to said center tap.

7. The electronic ballast system as recited in claim 6 where said feedback transformer means includes a first transformer resistor having a predetermined value coupled in series relation to said primary winding of said feedback transformer means for establishing a predetermined frequency value for said oscillation signal.

8. The electronic ballast system as recited in claim 6 where said feedback transformer means includes:

(a) a second transformer resistor having a predetermined value coupled in series relation to said center tap for initiating said oscillating signal; and, (b) a first transformer capacitor coupled to said center tap and said second transformer resistor for providing a reference value to said oscillating signal with respect to said power source, said second transformer resistor and said first transformer capacitor being coupled to provide a time delay in igniting at least one of said gas discharge tubes upon energization of said electronic ballast system.

9. The electronic ballast system as recited in claim 6 where said feedback transformer means includes a ferrite core transformer.

10. The electronic ballast system as recited in claim 6 where said feedback transformer means is operated in a saturation mode during operation of said gas discharge tubes.

11. The electronic ballast system as recited in claim 1 where each of said first and second transistor means includes a base element, a collector element, and an emitter element, said emitter element being coupled to said power source.

12. The electronic ballast system as recited in claim 11 where said base element of each of said first and second transistor means is coupled to opposing ends of said secondary winding of said feedback transformer means.

13. The electronic ballast system as recited in claim 12 where each of said transistor means includes a transistor base variable resistor coupled on opposing ends to said base element and said secondary winding of said feedback transformer means for controlling an amplitude value of said feedback signal.

14. The electronic ballast system as recited in claim 11 including a diode coupled in parallel relation to said base element and said emitter element.

15. The electronic ballast system as recited in claim 14 where said diode has a polarity opposite to a polarity of a junction of said base and emitter elements.

16. The electronic ballast system as recited in claim 11 where each of said colldctor elements of said first and second transistor means is coupled to opposing ends of said primary winding of said feedback transformer means and said tap terminal of said primary winding of said autotransformer.

17. The electronic ballast system as recited in claim 11 where said first and second transistor means are driven between (a) a conducting state and (b) a non-conducting state, responsive to said feedback signal, said first and second transistor means being alternatively driven between said states for generating said oscillation signal.

18. The electronic ballast system as recited in claim 11 where said first and second transistor means include a pair of transistor elements of the NPN type.

19. The electronic ballast system as recited in claim 1 where said tapped windings of said autotransformers are tapped in a manner to provide a primary winding coupled in series relation to a third secondary winding.

20. The electronic ballast system as recited in claim 19 where said third secondary windings are coupled at said output terminal in series relation to each of said first and second coupling capacitors respectively for developing the sum of said induced voltages in said primary and third secondary winding in said first and second coupling capacitors.

21. The electronic ballast system as recited in claim 1 where a first of said pair of secondary windings is coupled to said first filament and one of said first and second capacitance tuning means on opposing ends thereof for providing a heating current to said first filament of one of said gas discharge tubes.

22. The electronic ballast system as recited in claim 21 where a second of said pair of secondary windings is coupled to said second filament, one of said first and second capacitance tuning means and said power source.

23. The electronic ballast system as recited in claim 1 where said first and second autotransformer are operational in a linear characteristic manner.

24. The electronic ballast system as recited in claim 1 where said first and second autotransformer are ferrite core transformers.

25. The electronic ballast system as recited in claim 1 where said DC power source is generated by an AC power source to produce an AC signal.

26. The electronic ballast system as recited in claim 25 including bridge circuit means coupled to said AC power source, said feedback transformer means, said first and second transistor means, said first and second autotransformers, and said first and second capacitance tuning means for rectifying said AC signal from said AC power source.

27. The electronic ballast system as recited in claim 26 where said bridge circuit means includes a full wave bridge circuit.

28. The electronic ballast system as recited in claim 26 including filter means coupled to said full wave bridge circuit for providing a substantially constant DC output signal.

29. The electronic ballast system as recited in claim 1 where said gas discharge tubes are fluorescent tube elements.

* * * * *